United States Patent [19]

Staerzl

[11] 4,429,673

[45] Feb. 7, 1984

[54] PROGRAMMED COLD START ENRICHMENT CIRCUIT FOR A FUEL INJECTED INTERNAL COMBUSTION ENGINE

[75] Inventor: Richard E. Staerzl, Fond du Lac, Wis.

[73] Assignee: Brunswick Corporation, Skokie, Ill.

[21] Appl. No.: 329,990

[22] Filed: Dec. 11, 1981

[51] Int. Cl.[3] ..... F02B 3/00

[52] U.S. Cl. ..... 123/491; 123/179 L; 123/179 G

[58] Field of Search ..... 123/179 G, 179 L, 491, 123/492, 376

[56] References Cited

U.S. PATENT DOCUMENTS

| | | | |
|---|---|---|---|
| 3,673,989 | 7/1972 | Aono et al. | 123/491 |
| 4,126,107 | 11/1978 | Harada et al. | 123/491 |
| 4,227,507 | 10/1980 | Takase et al. | 123/492 |
| 4,326,488 | 4/1982 | Herth et al. | 123/492 |
| 4,349,000 | 9/1982 | Staerzel | 123/491 |

FOREIGN PATENT DOCUMENTS

| | | | |
|---|---|---|---|
| 16547 | 10/1980 | European Pat. Off. | 123/491 |

*Primary Examiner*—Parshotam S. Lall

*Attorney, Agent, or Firm*—Hopgood, Calimafde, Kalil, Blaustein & Judlowe

[57] ABSTRACT

The invention contemplates an electronic control unit in the form of a square-wave generator to serve the function of throttle and enrichment control in a fuel-injected internal-combustion engine. The output of the square-wave generator is an appropriately timed succession of square-wave pulses, of width (in terms of crankshaft rotation) which currently reflects computed evaluation of inlet-air temperature and pressure, engine speed, and start-up running condition of the engine. Under conditions of cold starting the pulse width of the square wave pulses is increased to provide fuel enrichment and, dependent upon engine throttle position the frequency of the square wave pulses may also be increased to provide additional fuel enrichment.

11 Claims, 2 Drawing Figures

PROGRAMMED COLD START ENRICHMENT CIRCUIT FOR A FUEL INJECTED INTERNAL COMBUSTION ENGINE

BACKGROUND OF THE INVENTION

This invention relates to fuel-injected internal combustion engines and more particularly to apparatus for enriching the fuel supply to such an engine when starting under cold ambient conditions.

Various types of fuel injection systems for internal combustion engines are well known and widely used for both automotive and marine applications. One particularly novel system for use in marine environments is described in my co-pending application Ser. No. 151,623, now U.S. Pat. No. 4,349,000 entitled Control Means For Fuel Injection In An Internal Combustion Engine, filed May 20, 1980 which in turn is a continuation-in-part of my co-pending application, Ser. No. 120,467, now U.S. Pat. No. 4,305,351 entitled Two-Cycle Engine With Fuel Injection, filed Feb. 11, 1980.

Said co-pending application Ser. No. 120,467 is particularly described in connection with internal-combustion engines of the two-cycle variety, wherein fuel-injection is made directly into the crankcase region, and wherein certain economies and design simplifications are achievable through utilization of the same injector-control pulse to satisfy the injector requirements of a plurality of the cylinders of the engine. At the same time, particular pulse-width modulating circuitry is described for implementing the control of fuel injectors in such engines, with the control circuitry having application to engines other than those of the two-cycle variety.

Said co-pending application Ser. No. 151,623 now U.S. Pat. No. 4,349,000 addressed the problem of cold-start up and in particular considered this problem in the context of the different approach necessary in an outboard-marine application vis-a-vis the automatic-choke approach of the automotive industry. More specifically said co-pending application Ser. No. 151,623 now U.S. Pat. No. 4,349,000 provides means for automatically causing transient enrichment of fuel supplied to an engine, upon engine start-up. Said transient enrichment is also automatically reduced to zero in a matter of seconds, with the magnitude of the enrichment a function of sensed inlet manifold temperature at start-up.

Although said co-pending application Ser. No. 151,623 now U.S. Pat. No. 4,349,000 provided fuel enrichment to solve the problem of cold start-up for an internal combustion engine in an outboard-marine application, it did so only as a function of engine-starter switch activation. The instant invention also provides fuel enrichment as a function of engagement of the engine-starter switch but also considers throttle position when determining the amount and frequency of providing fuel enrichment at start-up. Reliance on both parameters, activation of the engine-starter switch and throttle position, provides a reliable and accurate system more adaptable to varying engine conditions and a system capable of maximum fuel enrichment at the critical time of engine start-up under cold ambient conditions.

BRIEF STATEMENT OF THE INVENTION

It is a general object of the invention to provide improved electronic control means for the injector of a fuel-injection, multiple-cylinder internal-combustion engine.

It is another general object of the invention to provide such control means, with suitability for application to either two-cycle or four-cycle engines.

It is a specific object of the invention to provide improved means, associated with such electronic control means, for automatically causing transient enrichment of fuel supplied to an engine, upon engine-starting.

A further specific object of the invention is to achieve transient fuel-enrichment control of an outboard motor, the same to be automatically reduced to zero in a matter of seconds, and the magnitude of the enrichment to be a function of sensed inlet manifold temperature at start-up.

Another specific object of the invention is to provide fuel enrichment at engine start-up, the frequency of which is a function of engine throttle position.

A still further specific object of the invention is to provide a combined fuel enrichment system, a first portion of the combined system providing transient fuel enrichment at engine start-up and a second portion increasing the frequency of fuel enrichment as a function of throttle position.

Another general object of the invention is to accomplish the foregoing specific objects efficiently and rapidly for the case of an outboard motor.

A still further general object of the invention is to achieve the above objects with basically simple electronic components, lending themselves to compact rugged packaging of multiple performed functions, with simple flexible-lead input and output connections.

The invention achieves the foregoing objects and other features by providing an electronic control unit in the form of a square-wave generator to serve the function of throttle and enrichment control of solenoid-operated fuel-injectors in an internal-combustion engine. The only input manual control is a "throttle" displacement, and the output is an appropriately timed succession of square-wave pulses, whose width (in terms of crankshaft rotation) currently reflects computed evaluation of inlet-air temperature and pressure, engine speed, and start-up vs running condition of the engine. Under cold start-up conditions a first portion of the electronic control circuit increases the width of square-wave pulses to provide transient fuel enrichment each time the engine-starter switch is engaged. Similarly, a second portion of the electronic control unit, increases the frequency of the square-wave pulses as a function of throttle position to provide additional fuel enrichment when starting under cold ambient conditions.

DETAILED DESCRIPTION

Figure 1:
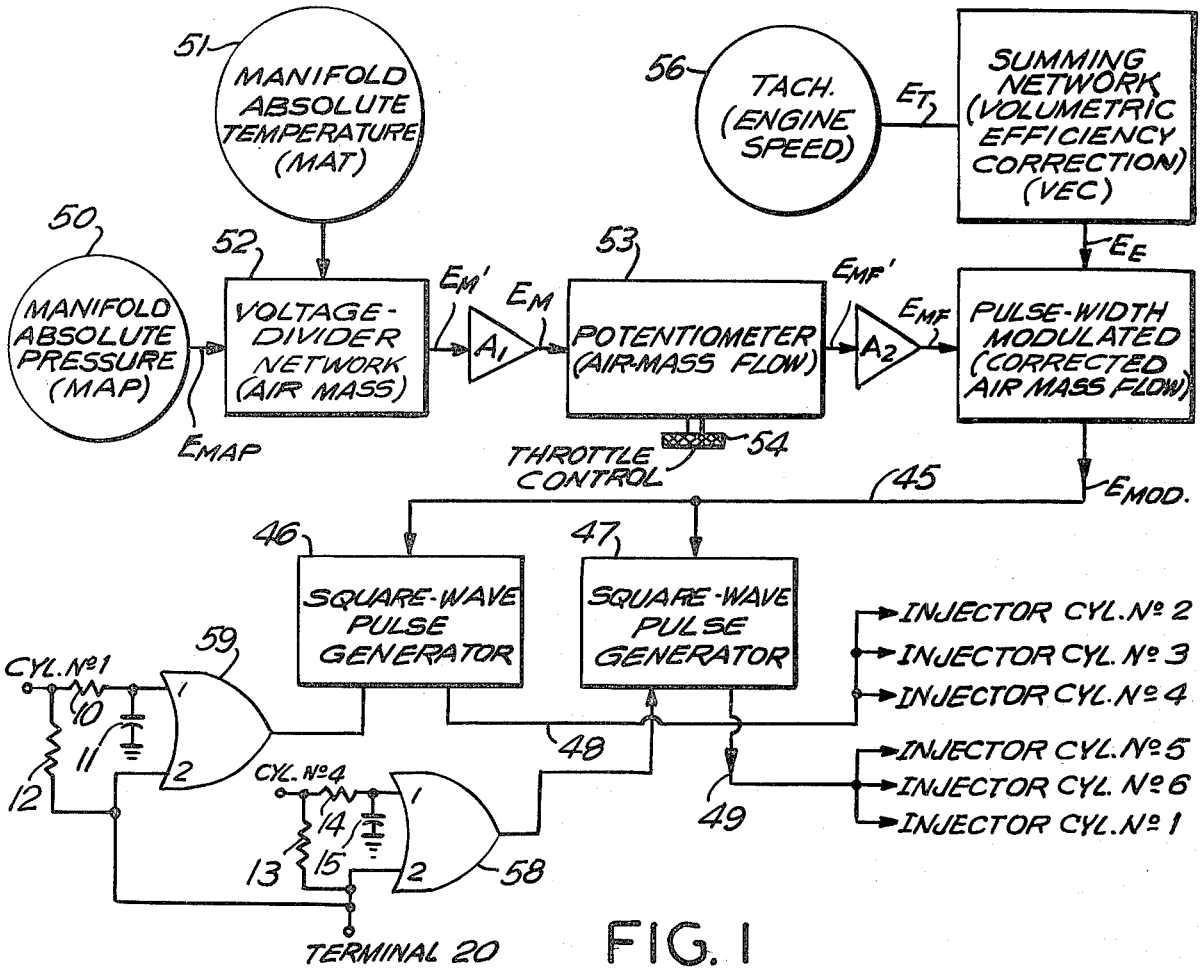
Figure 2:
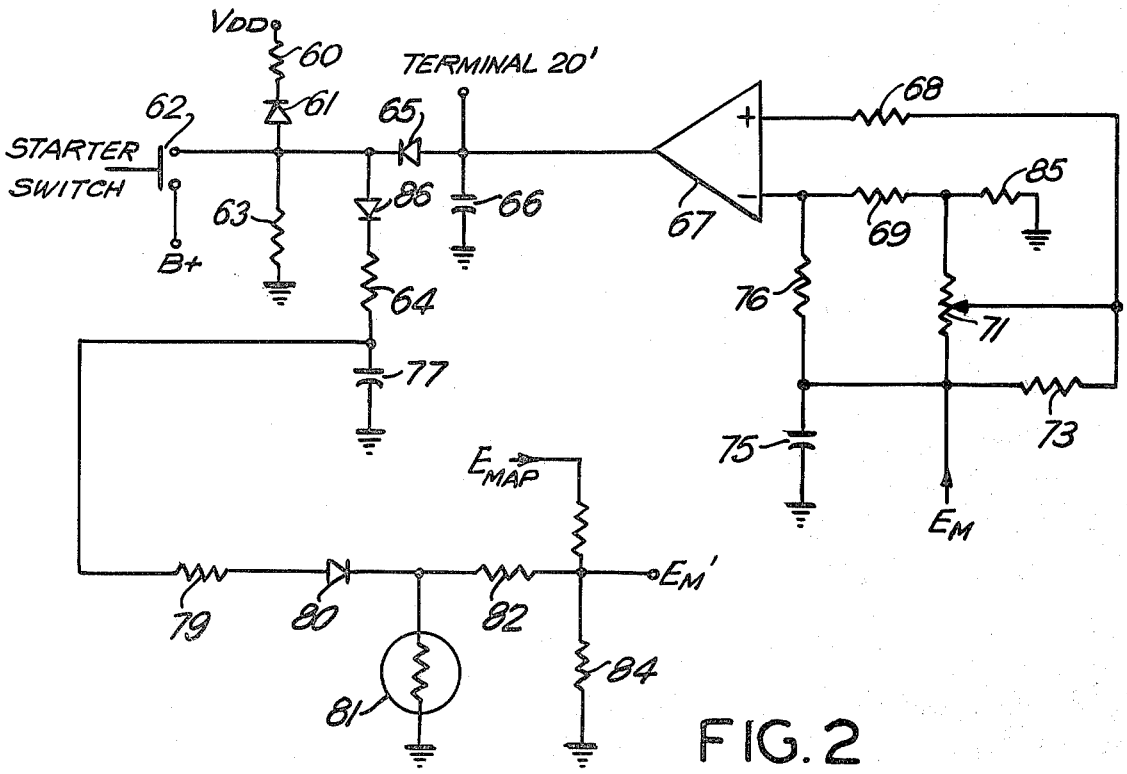

In conjunction with the accompanying drawings the invention will be described in the context of an electronic control unit when used with a two-cycle engine of the type described in my co-pending application Ser. No. 151,623. In said drawing:

FIG. 1 is an electrical block diagram, schematically indicating components of fuel-injection control circuitry, applicable to various embodiments of the invention, and FIG. 2 is an electrical circuit diagram schematically indicating the portions of the instant invention providing fuel enrichment under cold-start conditions.

In my co-pending application Ser. No. 151,623, which is incorporated herein by reference, there is described a two-cycle V-6 engine having two banks A-B of three cylinders at 60-degrees angular seperation. The instant invention is preferably used in conjunction with an engine of this type but it is understood that the instant invention can also be used with other types of fuel injection engines as will become apparent to one skilled in this technical area upon consideration of the following invention description.

Referring now to FIG. 1 there is shown an electronic fuel injection system of the type substantially shown in FIG. 6 of my copending application Ser. No. 151,623 but modified in accordance with the instant invention to provide fuel enrichment under cold-start conditions. More particularly, in said co-pending patent application, a fuel-injection internal-combustion engine is described in which one or more square-wave pulse generators (46 and 47) drive solenoid-operated injectors (not shown) unique to each engine cylinder, there being a single control system whereby the pulse-generator means is modulated as necessary to accommodate throttle demands in the context of engine speed and other factors. The circuit of FIG. 1 operates on various input parameters, in the form of analog voltages which reflect air-mass flow for the current engine speed, and a correction is made for volumetric efficiency of the particular engine, to arrive at a modulating-voltage output $E_{MOD.}$ in a line 45 to each of the two like square-wave pulse generators 46–47. Under normal operating conditions an input pulse associated with spark-plug firing in cylinder #1, is reduced in value to logic level signals by resistor 10 and capacitor 11 and than applied to one input of OR gate 59 to provide a trigger signal to generator 46. In response to this trigger signal generator 46 initiates the creation of an output pulse in line 48 to the injector solenoids (not shown) associated with the three cylinders #2, #3 and #4. Similarly, spark-plug firing in cylinder #4, creates a pulse which is reduced in value by resistor 14 and capacitor 15 to logic level signals, the pulse being applied to one input of OR gate 58 to provide a trigger signal to generator 47. In response to this trigger signal generator 47 initiates the creation of an identical output pulse in line 49 to the injector solenoids (not shown) associated with the remaining three cylinders #5, #6 and #1. Depending upon the magnitude of the modulating voltage $E_{MOD.}$ in line 45, the square-wave output at 48 will be of predetermined duration, and the square-wave output at 49 will always be of duration identical to that in line 48, it being understood that the predetermined duration is always a function of instantaneous engine-operating conditions.

More specifically, for the circuit shown, a first electrical sensor 50 of engine manifold absolute pressure is a source of a first voltage $E_{MAP}$ which is linearly related to such pressure, and a second electrical sensor 51 of manifold absolute temperature may be a thermistor which is linearly related to such temperature, through a resistor network 52. The voltage $E_{MAP}$ is divided by the network 52 to produce an output voltage $E_M'$ which is a linear function of instantaneous air-mass or density at the inlet of air to the engine. A first amplifier $A_1$ provides a corresponding output voltage $E_M$ at the high-impedance level needed for regulation-free application to the relatively low impedance of a potentiometer 53, having a selectively variable control that is symbolized by a throttle knob 54. The voltage output $E_{MF}'$ of potentiometer 53, reflects a "throttle"-positioned pick-off voltage and thus reflects instantaneous air-mass flow, for the instantaneous throttle (54) setting, and a second amplifier $A_2$ provides a corresponding output voltage $E_{MF}$ for regulation-free application to one of the voltage-multiplier inputs of the pulse-width modulator 55, which is the source of $E_{MOD.}$ already referred to.

The other voltage-multiplier input of modulator 55 receives an input voltage $E_E$ which is a function of engine speed and volumetric efficiency. More specifically, a tachometer 56 generates a voltage $E_T$ which is linearly related to engine speed (e.g. the speed of the engine crankshaft, or repetition rate of one of the spark plugs), and a summing network 57 operates upon the voltage $E_T$ and certain other factors (which may be empirically determined, and which reflect volumetric efficiency of the particular engine size and design) to develop the voltage $E_E$ for the multiplier of modulator 55. The modulator 55 will further be understood to include provision for a fixed voltage bias to be added to the product of voltages $E_{MF}$ and $E_E$ whereby the modulating-voltage output $E_{MOD.}$ additionally reflects a fixed allowance for above-noted inertial characteristics of the initial phase of exciting the particular fuel-injector assembly 34 which has been adopted for the engine. To summarize, the output of modulator 55 will be seen as a voltage $E_{MOD.}$ whose amplitude is linearly related (at 46, and at 47) to the time duration of pulses initiated by the respective firing-pulse inputs to generators 46 and 47. It is also to be understood that various alternate embodiments of the square wave generator, such as are shown in my co-pending application Ser. No. 151,623 can also be used in conjunction with the instant invention.

Referring now to FIG. 2 the present invention is particularly concerned with providing fuel enrichment as a function of activation of the engine starter switch and as a function of throttle position. More particularly, assume for purposes of discussion, that the engine operator initially attempts to start the associated internal combustion engine with the throttle in a closed position, that is with the throttle opened less than 10°. In this condition, as will be described in detail below, the output of comparator 67 is essentially at circuit ground which grounds terminal 20' (FIG. 2) and also terminal 20 (FIG. 1) which is connected to terminal 20'. With closed throttle the circuit of FIG. 1 operates essentially as described above, with trigger signals from cylinders #1 and #4 serving to activate generators 46 and 47 which in turn apply square wave pulses to the associated injector solenoids (not shown). A trigger pulse from cylinder #1 is also applied to one input of OR gate 58 via resistor 12 and a trigger pulse from cylinder #4 is also applied to one input of OR gate 59 via resistor 13. At this time however the application of a cylinder #1 trigger pulse to the OR gate associated with cylinder #4 and vice versa has no effect on circuit operation as each "cross over" pulse is grounded at terminal 20, 20'.

A first portion of the circuit detail of FIG. 2 illustrates a cold-start enrichment feature particularly suited to outboard-motor applications, whereby a pulse widening bias is incorporated into the voltage $E_M'$ (and thus also conveyed to the pulse width modulator 55). In particular the bias is applied to a leaky storage device (capacitor) 77 upon starting the engine with the magnitude of the bias being inversely related to manifold absolute temperature ($E_{MAT}$), e.g. the colder the sensed temperature at start-up the greater the effect of the bias in the pulse-widening sense. As described below the bias charge impressed on the leaky storage device degrades to zero in a matter of seconds, with the time of delay being inversely dependent upon sensed temperature once the bias charge has been applied to the storage device.

More specifically, air entering the engine is temperature-sensed by a bead thermistor 81, positioned in the engine's inlet-air manifold (not shown). Thermistor 81 provides the electrical resistance for one arm of a bridge or voltage divider, the other arm of which is a resistor 82 of approximately 3000 ohms fixed resistance. The nature of thermistor 81 resistance is to vary non-linearly and inversely with temperature exposure, e.g. exhibiting resistance of 2000 ohms, 8000 ohms and 50,000 ohms at 60°, 25° and 0° C. respectively. Taken together, the elements of 81, 82 provide a temperature responsive variable resistance shunt across which the output voltage $E_M'$ is supplied via amplifier $A_1$ to potentiometer 53, the voltage $E_{MAP}$ is applied across a larger fixed resistance 83 (e.g. 20,000 ohms) which is in series with resistance 84 (as shunted by the temperature responsive voltage-dividing resistance 81, 82). In the normal cause of events (i.e., a running engine) the voltage $E_M'$ is determined solely by the described components 81–84, electrically reflecting the desired evaluation of current manifold pressure and temperature.

Fuel enrichment is provided whenever the engine starter switch 62 is engaged, battery voltage, B+ (e.g. 12.6 volts) rapidly charging capacitor 77 via protective diode 86 and a dropping resistor 64. At this time, due to the limitation imposed by the power supply VDD and the drop across diode 61 and resistor 60, a charge voltage of approximately 8.6 volts is developed across capacitor 77 and is applied at a reduced level via a large resistor 79 and protective diode 80 for addition to the air density signal $E_M'$ already described. An increase in the amplitude of signal $E_M'$ serves to increase the pulse width of generators 46 and 47 which in turn provides increased fuel enrichment in the manner described above.

When the starter switch 62 is disengaged, pulse-widening "enrichment" is slowly reduced to zero (e.g. in about 10 seconds) due to the slow decay of the capacitor charge through the resistor network 79,81,82,84. It will be understood that the pulse-widening "enrichment" effect (at $E_M'$) of the charge across capacitor 77 will be an inverse function of the currently sensed-temperature condition of thermistor 81 namely, the colder the sensed temperature, the larger the resistance of thermistor 81 with respect to the resistance of resistor 82, and it will be further understood that the time required for the charge across capacitor 77 to leak to zero will also be an inverse-function of the temperature sensed at 81 i.e., the colder the sensed temperature, the longer it will take for the fuel-enriching charge at 77 to leak to zero.

The portion of the fuel enrichment circuit just described increases the pulse width of the pulse width generators each time the engine starter switch is engaged. The increase in pulse width, and thus the amount of fuel enrichment, is inversely related to the temperature sensed at thermistor 81 with a cold engine resulting in greater fuel enrichment. The remainder of the circuitry in FIG. 2, e.g. comparator 67 and its associated components serves to increase the frequency of pulses from generators 46 and 47 to supply increased fuel enrichment.

More particularly potentiometer 71 forms one leg of a voltage divider network, the other leg being comprised of resistors 69, 76 and 85. Voltage $E_M'$ from amplifier A1 in FIG. 1, is applied to one end of potentiometer 71, the other end being applied to the "−" input of comparator 67 via resistor 69, and the "wiper arm" of the potentiometer being applied to the "+" input of comparator 67 via resistor 68. Potentiometer 71 is similar to potentiometer 53 (FIG. 1) and functions as a throttle position sensor with the "wiper arm" of the potentiometer being "highest" (maximum pick-off resistance) with a closed throttle and progressively moving "downward" in FIG. 2 (minimum pick-off resistance) as the throttle position opens. With a closed throttle position the voltage divider network of potentiometer 71 and resistors 69, 76 and 85 divides voltage $E_M$ such that the potential at the "−" input of comparator 67 exceeds the potential at the "+" input. This in turn results in a "low" output from comparator 67, grounding terminal 20, 20' and preventing the "cross-over" trigger pulses described above from affecting the operation of the circuit in FIG. 1.

Under cold-start conditions, particularly with outboard marine engines of the type described herein, the engine operator is instructed to move the throttle to a cold-start position, which advances the throttle position approximately 15°. This in turn moves the "wiper arm" of potentiometer 71, from the closed position of maximum pick-off resistance to a higher pick-off resistance position. The voltage divider network of potentiometer 71 and resistors 69, 76 and 85 previously described divides voltage $E_M$ such that at a throttle position of 10° or greater the potential at the "+" input of comparator 67 exceeds the potential at the "−" input which causes the output of the comparator to go "high" and removes the ground potential from terminals 20,20'. It is to be understood that the output of comparator 67 functions only as a "sink" and not a "source" in circuit operation.

With terminal 20,20' ungrounded, and activation of starter switch 62, diode 65 is reverse biased and functions as a "clamp" circuit to hold the potential of terminal 20,20' to approximately 12 volts. Under these conditions a trigger pulse being applied from cylinder #1 (FIG. 1) is fed through resistor 12, clamped to approximately 12 volts and applied to input 2 of OR gate 58. The trigger pulse from cylinder #1 is also applied to input 1 of OR gate 59 through resistor 10 and capacitor 11 in the mannper previously described. Permitting the "cross over" pulse from cylinder #1 to be applied to OR gate 58 results in simultaneous activation of both generators 46 and 47, doubling the frequency of the square-wave pulses being applied to the injector solenoids and thus doubling the amount of fuel supplied to the associated internal combustion engine. It is of course understood that a trigger pulse from cylinder #4 under these conditions will "cross-over" to OR gate 59 and also serve to double the amount of fuel supplied to the engine. Upon closing the throttle to a position of less than 10° the output of comparator 67 will again ground terminals 20,20' and restore the circuit to the mode of operation described above. Resistor 73 functions as a safety enrichment component and will maintain the output of comparator 67 high in the event the "wiper arm" of potentiometer 71 should become open through contamination or inadvertant failure. It is of course also understood that diode 65 is only reverse biased when the starter switch is activated so that under running conditions the "cross over" pulses described above will be grounded through diode 65 and resistor 63 regardless of throttle position and the attendant output of comparator 67.

The described embodiments of the invention will be seen to have achieved all stated objects. In the particular case of outboard-motor application, i.e. in a marine context, the invention recognizes that ambient-temperature extremes are never as great as for automotive applications, so that engine-block temperature-control of choking (fuel enrichment) at start-up is not necessary. Moreover by providing two separate means of fuel enrichment, one based solely on starter switch activation, and a second based on a combination of starter switch activation and throttle position, maximum fuel enrichment is provided under critical cold-start conditions without undesirable features often encountered with operation which is predicated on the continuous tracking of engine-block temperature.

While the invention has been described in detail for preferred and illustrative embodiments it will be understood that various modifications may be made without departure from the claimed scope of the invention.

What is claimed is:

1. Electronic pulse generating means for timing the solenoid-excitation of a fuel-injection solenoid valve in a throttle controlled internal combustion engine, comprising, means responsive to incoming trigger signals generated by engine cylinder firing for normally enabling said pulse generating means at a first predetermined frequency of pulse generation, means responsive to a continuously evaluated plurality of electrically sensed parameters for varying the pulse width generated by said pulse generating means under conditions of normal engine operation, means responsive to engine starting under cold operating conditions for enabling said varying means to increase said pulse width and means responsive to engine starting and engine throttle position for enabling said pulse generating means at a second predetermined frequency of pulse generation.

2. Electronic pulse generating means in accordance with claim 1 wherein said means for enabling said varying means includes a leaky storage device having a charging condition responsive to engine starting and being in transient fuel-enriching relation with said varying means for transiently increasing pulse width output of said pulse generating means upon engine starting, said storage device including means for charging the same in inverse relation to sensed engine manifold absolute temperature.

3. Electronic pulse generating means in accordance with claim 1 wherein said means for enabling said pulse generating means includes means for detecting a predetermined throttle position.

4. Electronic pulse generating means for timing the solenoid-excitation of a fuel-injection solenoid valve in an internal combustion engine, comprising, an input connection for pulse-initiating response to a predetermined angle event in a cycle of the engine, pulse-width modulating means and computer means having a control signal connected to said modulating means for varying the pulse width generated by said pulse-generating means in accordance with a continuously evaluated plurality of electrically sensed parameters; said parameters specifically including manifold absolute temperature, manifold absolute pressure, throttle setting and engine speed, said parameters being normally evaluated for a predetermined fuel-air relation for normal running of the engine; a leaky storage device having a charging connection responsive to engine-starting and in transient fuel-enriching relation with said computer means for transiently increasing pulse-width output of said pulse-generating means upon engine-starting, said storage device including means for charging the same in inverse relation to sensed manifold absolute temperature, and means responsive to engine-starting and throttle setting for increasing the output frequency of said pulse generating means.

5. Pulse-generating means according to claim 4, in which said leaky storage device including means varying the rate of leakage in inverse relation to sensed manifold absolute temperature.

6. Pulse-generating means according to claim 4, in which said pulse-generating means includes a bead thermistor for providing an electrical resistance inversely related to sensed manifold absolute temperature, and in which said leaky storage device is a capacitor in charge-leaking connection relation to said thermistor.

7. Pulse-generating means according to claim 6, in which the charging connection includes a regulated power supply of lesser voltage output than the engine-starting battery voltage, and means including a starter switch contact and a dropping resistor for applying a battery-derived charging voltage to said capacitor, said power supply being diode-connected to said capacitor to assure a predetermined limit of charge on said capacitor for each application of charge to said capacitor.

8. Pulse-generating means according to claim 7, in which said charge-leaking connection includes a resistor of substantially greater resistance value than that of said dropping resistor.

9. Pulse-generating means according to claim 7, in which said charge-leaking connection includes a resistor of resistance value which is in the order of magnitude of that of said thermistor at the cold end of the requisite response range thereof.

10. Pulse-generating means according to claim 7, in which said charge-leaking connection includes a resistor and a protective diode.

11. Pulse-generating means in accordance with claim 4 wherein said output frequency increasing means includes means for determining said throttle setting, means for detecting when said throttle setting exceeds a predetermined value and means responsive to engine starting and said detecting means for enabling said output frequency increasing means.

* * * * *